US006257622B1

(12) United States Patent
Peker

(10) Patent No.: US 6,257,622 B1
(45) Date of Patent: Jul. 10, 2001

(54) CLOTH BOOKCOVER

(76) Inventor: Sharon A. Peker, 26 Elizabeth Dr., Hopewell Junction, NY (US) 12533

( * ) Notice: Subject to any disclaimer, the term of this patent is extended or adjusted under 35 U.S.C. 154(b) by 0 days.

(21) Appl. No.: 09/589,191

(22) Filed: Jun. 8, 2000

Related U.S. Application Data

(60) Provisional application No. 60/145,257, filed on Jul. 26, 1999.

(51) Int. Cl.[7] ..... B42D 3/00

(52) U.S. Cl. ..... 281/29; 281/34; 281/35; 281/27; 281/19.1; 281/16; 412/3; 412/1; 412/17

(58) Field of Search ..... 281/15.1, 16–17, 281/18–19.1, 27–29, 31, 34–35, 37, 51; 412/1, 3, 4, 5, 17–19, 24

(56) References Cited

U.S. PATENT DOCUMENTS

| | | | | |
|---|---|---|---|---|
| 3,572,767 | * | 3/1971 | Learned et al. | 281/34 |
| 4,209,187 | * | 6/1980 | Forrest | 281/34 X |
| 4,853,994 | * | 8/1989 | Ekstein | 281/31 X |
| 4,856,436 | | 8/1989 | Campbell . | |
| 4,932,524 | | 6/1990 | Hodson . | |
| 5,004,514 | | 4/1991 | Pugliese et al. | 281/29 X |
| 5,013,068 | | 5/1991 | Maldonado | 281/31 |
| 5,029,900 | | 7/1991 | Axelrod | 281/321 |
| 5,056,663 | | 10/1991 | Ostrowski | 281/34 X |
| 5,092,630 | | 3/1992 | Ostrowski | 281/34 |
| 5,158,325 | | 10/1992 | Landis et al. | 281/42 |
| 5,209,624 | | 5/1993 | Nicolaisen | 412/4 |
| 5,219,437 | | 6/1993 | Moor et al. | 281/29 |
| 5,470,109 | | 11/1995 | Grande | 281/321 |
| 5,676,482 | * | 10/1997 | Hawkins | 281/38 X |

FOREIGN PATENT DOCUMENTS 444487 4/1936 (GB) .

* cited by examiner

*Primary Examiner*—Willmon Fridie, Jr.
(74) *Attorney, Agent, or Firm*—Richard C. Litman

(57) ABSTRACT

The improved cloth book cover according to the invention has a spine area, and a front and back cover portion having pockets at the two lateral edges in which the front cover and the back cover of a book may be inserted. The cover is made from an elastic fabric, preferably spandex, so that the cover is elastically retained on the book. The cloth material is also preferably water resistant and flame retardant. An optional pocket located on the outside spine area of the book cover may be fashioned to contain pens, pencils, rulers, etc. A method of making the cloth book cover uses overlock stitching along the top and bottom edges of the cover and along the unfolded edges of the pockets.

8 Claims, 5 Drawing Sheets

CLOTH BOOKCOVER

CROSS-REFERENCE TO RELATED APPLICATION

This application claims the benefit of U.S. Provisional Patent Application Ser. No. 60/145,257, filed Jul. 26, 1999.

BACKGROUND OF THE INVENTION

1. Field of the Invention

The present invention relates generally to protective book covers. More specifically, the invention is an improved expandable cloth book cover and method for simultaneously covering a book and elastically retaining various items (e.g., pencils, rulers, etc.) therein.

2. Description of Related Art

A variety of book covers have been devised for protecting and preserving books from deterioration and for resale. Most of the conventional book covers have utilized plastic materials for protecting books from external moisture which is unattainable for paper based book covers. While there are advantages in the use of plastic based covers, there are some disadvantages associated therewith. Over time, plastic covers tend to crack at corners or in areas where heat seals have been formed, primarily due to cyclic stresses which result in material fatigue. For this reason, it becomes nearly impossible to restore the plastic cover for life long use. Cloth type covers which have tried to remedy the problems of plastic covers have failed to overcome the problem of material failure due to cyclic stresses as above mentioned. An improved cloth book cover which is flexible and virtually impervious to cyclical stresses as herein described is lacking.

For example, U.S. Pat. No. 5,004,514 issued to Pugliese et al. discloses a method of making a protective book covering including a relatively long piece of plastic sheet material and a relatively short piece of plastic sheet material overlying the long piece, the longitudinal edges of the two sheets being heat sealed together with the option of applying a strip of adhesive on one longitudinal edge.

U.S. Pat. No. 5,013,068 issued to Maldonado discloses a protective envelope for a book comprising a stretchable sheet of compressible synthetic polymer fabric and a relatively thick layer of closed cell elastomeric compressible foam, lined on one side. The sheet is a composite such as foamed neoprene and stretchable nylon. The foam has a thickness between 1/32 inch and 1/16 inch.

U.S. Pat. No. 5,029,900 issued to Axelrod discloses a wrap-around plastic cover for a bound book comprising a rectangular sheet having a center portion that abuts the book spine, with side portions of the sheet being folded inward to overlie the front and rear covers of a book to be protected. The distal portions of the rectangular sheet are formed with inwardly facing flaps which receive the outer portions of the front and rear covers of the bound book as a removable cover.

U.S. patents issued to Ostrowski (U.S. Pat. Nos. 5,056,663 and 5,092,630), Grande (U.S. Pat. No. 5,470,109) and Landis et al. (U.S. Pat. No. 5,158,325) disclose adjustable protective book covers having similar features. The U.S. patent issued to Ostrowski ('663) discloses an adjustable cover having releasable hook and loop fasteners or adhesives which are used to secure the cover to a book. The U.S. patent issued to Ostrowski ('630) discloses a one size fits all book cover which comprises a sheet material with folded over top and bottom edges and side edges with short hems.

The side edges are folded over to the width of the back, forming side pockets for insertion of a book cover therein.

U.S. Pat. No. 5,470,109 issued to Grande discloses an adjustable book jacket made of spandex material which is cut in a unique diamond shaped pattern wherein two diagonal stitched seams converge to form the apex of a triangle for inserting front and back bound book portions. This arrangement has the tendency for creating cyclical stresses along the interior seams which contribute to wear and tear from repeated use.

The cover also leaves exposed to the elements top and bottom spine portions of the covered book which is cause for additional wear on the book. The "spine locking" feature does not work effectively. Another problem is that when the cover is used on larger books, the cloth cover is easily torn at the spine.

The design causes more stress (elastic pull) on the right and left book cover jacket flaps (right and left). The book cover does not include the top and bottom areas of the spine sewn across. Because of these two factors, they cause an unsightly sagging at that area. When the book cover is stretched at the top/bottom area of the spine a correct curve should occur and the cover then protrudes above the spine area. In order to stay above the spine area and not sag, it must be made to protrude significantly.

The success of any adjustable book jacket depends directly on the degree of four-way stretch in the material and how the stretch is utilized. It is the nature of stretchy material such as spandex to lose some of this quality in the sewing process. The degree to which this occurs, therefore, depends on the amount of sewing and altering of the fabric. Grande's diamond design requires significant altering of the material and an intricate sewing pattern. Consequently, a significant degree of the two-way vertical stretch, necessary for adequately covering the spine area, is reduced. Completely covering larger books at the spine area without tearing the book jacket is potentially problematic. My book cover reduces this assault on the fabric thereby retaining the mandatory four-way stretch. It is easier to construct and results in a book cover which has a far greater chance of covering a much wider size range of books with one size cover.

U.S. Pat. No. 5,158,325 issued to Landis et al. discloses an adjustable book cover similar to that taught by Grande, except that the insertable book cover pockets form a sinusoidal stitched seam at the lip of the insert portion of the cover. An attached, non-removable book marker is neither needed or useful for several reasons. First, the book pages may be easily inserted into the front and\or back flap areas of a cloth book cover. The book can still be easily closed without damage to the pages, covers, or spine of the book. Secondly, an attached book marker is bothersome if not used and adds bulk to the inside of the book. Some people prefer not to use a bookmark making the attached marker cumbersome. Also, many people prefer to purchase personal bookmarks such as those sold in retail stores.

U.S. Pat. No. 5,209,624 issued to Nocolaisen discloses a method for interconnecting two sheets or plates for covering a book. The cover comprises an adhesive layer applied to a narrow zone extending along and adjacent to at least one end of a plate. A free end portion of each plate folds along a folding line which defines an acute angle with the longitudinal axis of the protective strip whereby the free end portion of the protective strip extends beyond the edge of the sheet to form a gripping end.

U.S. Pat. No. 5,219,437 issued to Moore et al. discloses a fabric covered book cover comprising a front leaf and back leaf board, a spine having a plurality of integral ridges formed therein for increased foldability. The inside and outside surfaces of the cover are covered by woven nylon or another synthetic material.

Great Britain Patent No. 444,487 issued to Shrimpton discloses a book cover having conventional features which are of general significance to that of the cloth book cover as herein described. Other Patents of general significance are U.S. patents issued to Campbell (U.S. Pat. No. 4,856,436) and Hodson (U.S. Pat. No. 4,932,524), Great Britain Pat. No. 905,483 issued on September of 1962. U.S. Pat. No. 4,856,436 issued to Campbell discloses an automatically expanding protective cover for electronic equipment. The cover comprises a pair of telescoping arms made from a resilient material. The arms are positioned contiguous with a pair of bases which are located parallel with each other on the floor on either side of the electronic equipment with a hinged cover enclosure between the ends which form a "U" shape.

U.S. Pat. No. 4,932,524 issued to Hodson discloses a computer cover comprising a fabric member configured to conform to the general shape of a computer and is permits heat dissipation a as a porous fabric. The fabric contains at least one flap to permit access to a floppy drive.

None of the above inventions and patents, taken either singly or in combination, is seen to describe the instant invention as claimed.

SUMMARY OF THE INVENTION

The improved cloth book cover according to the invention has a spine area, and a front and back cover portion having pockets at the two lateral edges in which the front cover and the back cover of a book may be inserted. The cover is made from a stretchy material, preferably spandex with nylon or cotton blend, or a stretchy tricot, for example. These fabrics are readily available. The cloth material is also preferably water resistant and flame retardant. A method of making the cloth book cover is disclosed which uses overlock stitching along the top and bottom edges of the cover and along the unfolded edges of the pockets.

Accordingly, it is a principal object of the invention to provide a cloth book cover which is a virtually life long reusable cover.

It is another object of the invention to provide a cloth book cover which made from elastic for better retention of the cover on the book.

It is a further object of the invention to provide a cloth book cover which is flexible and flame retardant.

Still another object of the invention is to provide a cloth book cover with a "one size fits all books" (generally speaking) capability.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
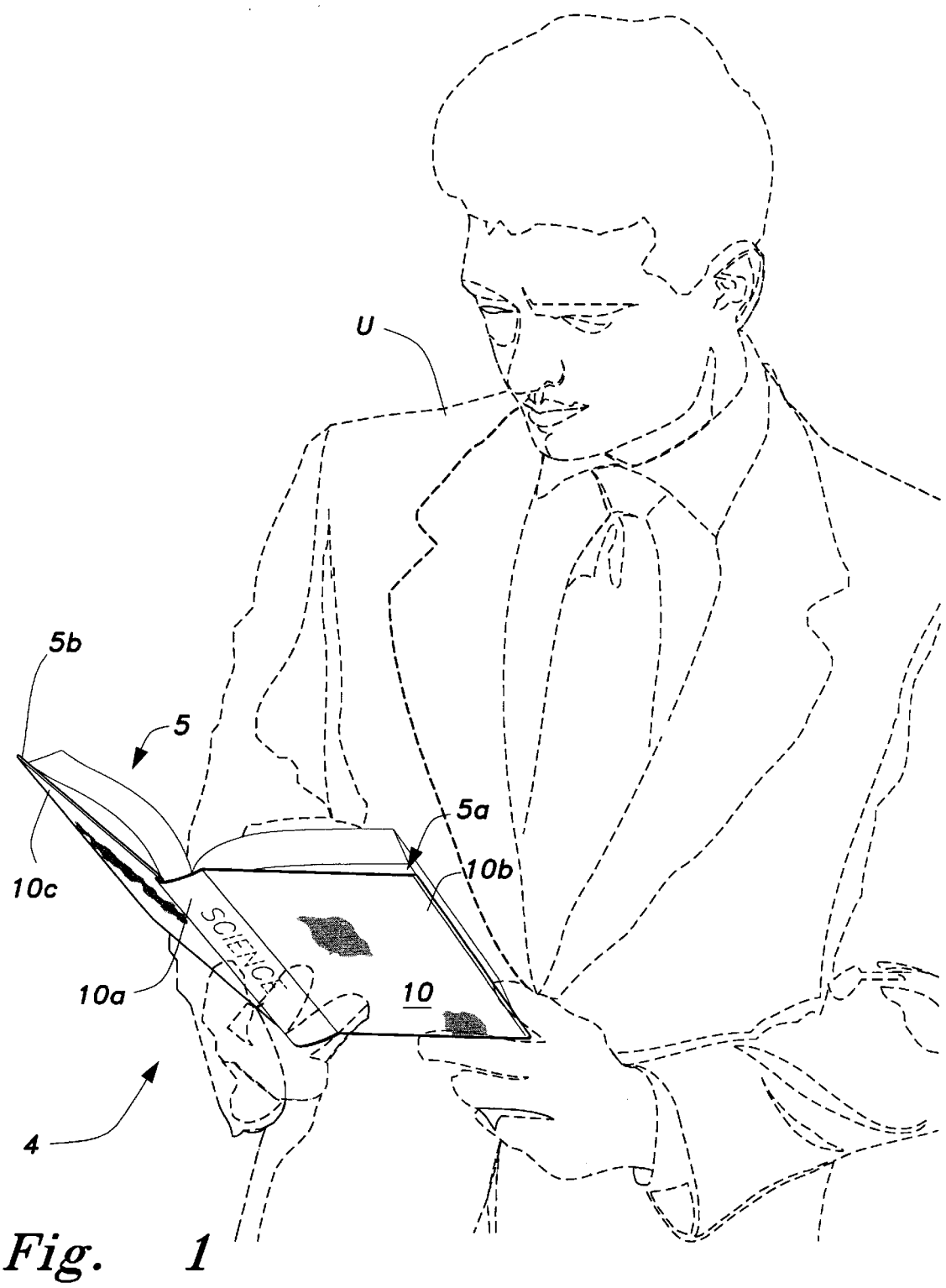
FIG. 1 is an environmental, perspective view of a cloth book cover according to the present invention.
Figure 2:
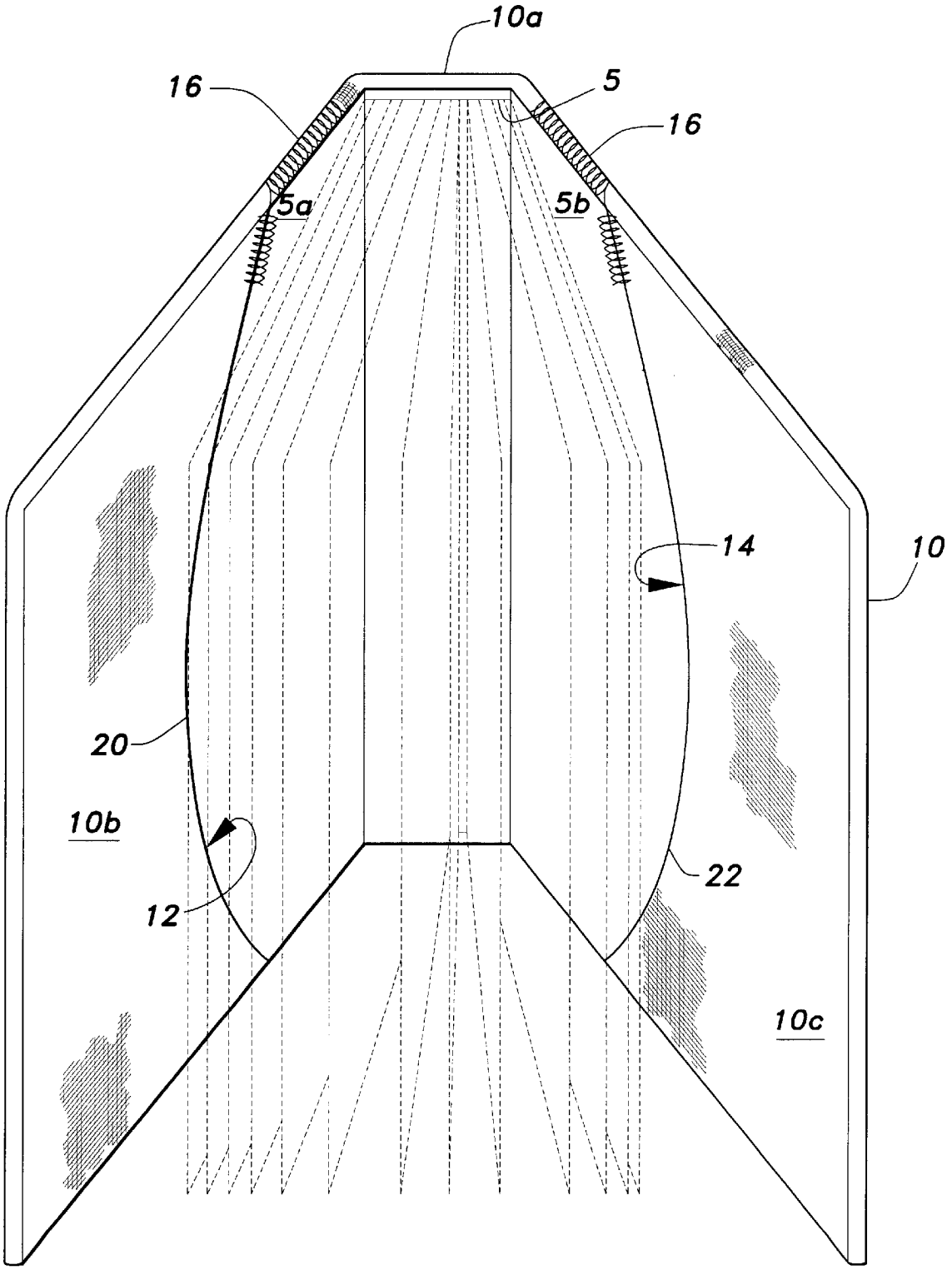
FIG. 2 is a perspective view of the inside of a cloth book cover with a book shown in phantom, only a portion of the stitching being shown along the top cover edge and the edge of the pockets.
Figure 3:
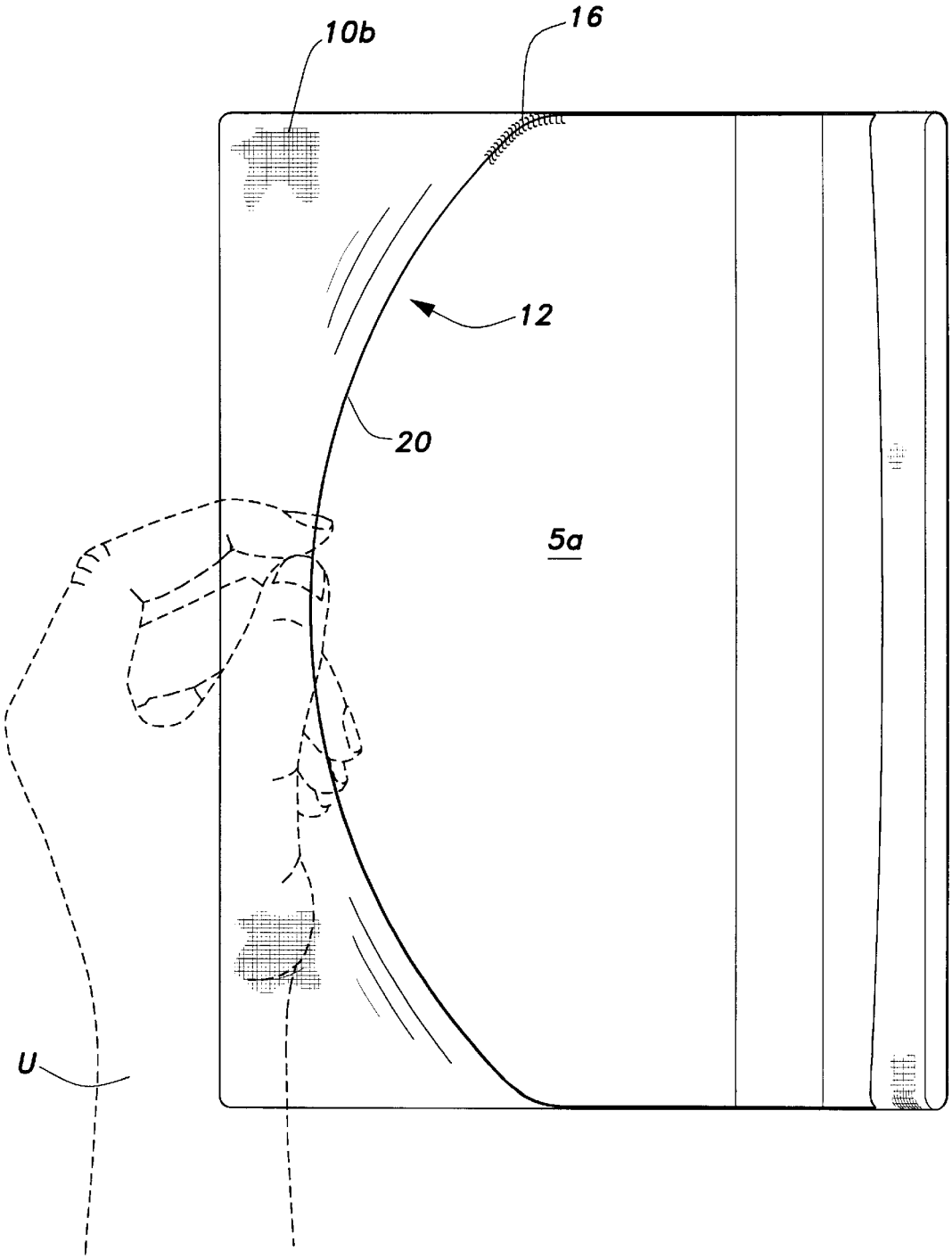
FIG. 3 is a perspective view of the inside of the front portion of a cloth book cover according to the invention, illustrating the elastic nature of the pocket.

The present invention is directed to an improved cloth book cover and a method of making a book cover from an elastic fabric in order to withstand the repeated cyclical stress of opening and closing the book. In addition, the improved book cover is constructed to remain secure to the book without falling off the book while in use. The preferred embodiment of the invention is depicted in FIGS. 1–3, and is generally referenced by numeral 4. As seen in FIGS. 1–3, the improved cloth book and cover 4 enclosing a bound book 5 shown in the hand of a user U. The cloth cover 10 has a spine area 10*a*, a front cover portion 10*b*, a back cover portion 10*c*, a first lateral pocket 12 inside the front cover portion 10*b*, and a second pocket 14 inside the back cover portion 10*c*. The front cover 5*a* of a book is inserted into the first lateral pocket 12 and the back cover 5*b* of a book is inserted into the second lateral pocket 14, as shown in FIG. 2, so that the front cover 5*a* is protected by the front cover portion 10*b*, and so that the back cover 5*b* is protected by the back cover portion 10*c*. The cloth book cover 10 is made from an elastic fabric, preferably spandex, sold under the trade name Lycra®, so that the cover 10 is retained tautly on the cover of the book 5. The fabric is also preferably water resistant and flame retardant, either naturally or by treatment with chemical coatings, as is well known in the art. The cover 10 is prepared using overlock stitching according to the method set forth below, a fragment only of the overlock stitching 16 being shown in FIGS. 2 and 3. It is important to note here that overlock stitching is a wrapping stitch that protects the edges of material from unraveling, and also adds strength without being bulky. Overlock stitching flexes with the material and therefore is very useful with materials that stretch.

An optional spine pocket (not shown) for the retention of pens, pencils, rulers, etc. may be constructed within the book cover 10. After the rectangular piece of material is cut for the book cover 10, a location approximately one inch from the top of the rectangle of what would be the spine area 10*a* on the book cover 10 and exactly equidistant from the right and left short edges of the rectangular material of what will be the book cover 10 is determined.

A second rectangular piece (not shown) of material is cut to exactly match in material and color the rectangle that will become the book cover 10. This second piece is approximately 6.25 inches long and one inch wide. The size may be adjusted if desired. Approximately a 0.25 inch of one short side is folded upward toward the opposite side of the rectangle and stitched. The right long side is folded inward 0.25 inch and stitched; this step is repeated with the left long side. The pocket, which now measures six inches long and half an inch wide is stitched to the spine area 10*a* of the unfinished book cover, on the side of the material which is to be the outside book cover, as described above.

Figure 4:
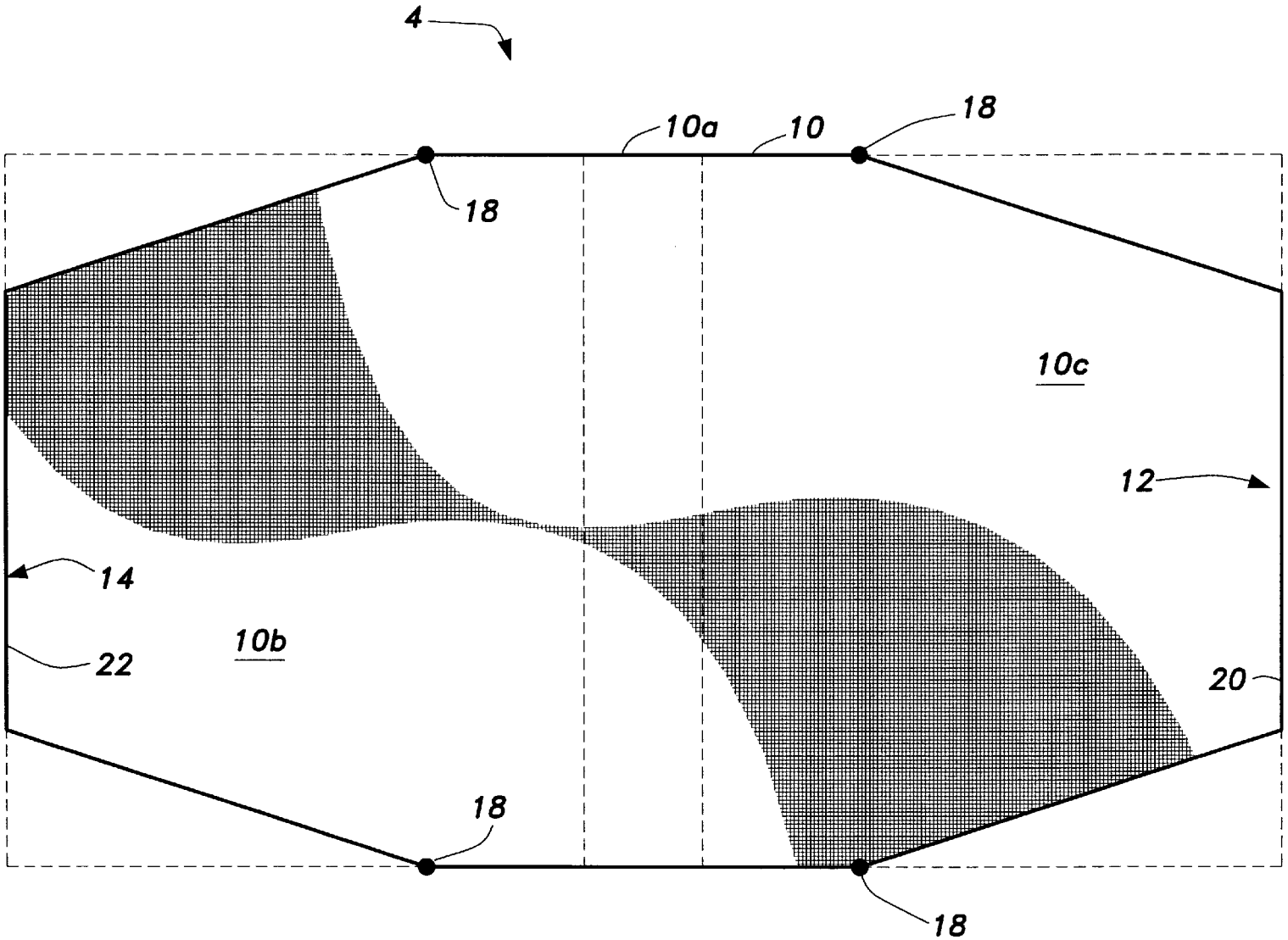
FIG. 4 is a perspective view of the pattern of the book cover when cut and sewn.

The method of making the cover 10 includes a rectangular piece of elastic fabric, preferably spandex, which is laid out flat. The rectangular piece has a top edge, a bottom edge, a first lateral edge adjacent the front cover portion 10*b*, and a second lateral edge adjacent the back cover portion 10*c*. The width of the first lateral pocket 12 is measured along the top edge from the first lateral edge and a short notch 18 (shown in FIG. 4) is cut in the fabric. Similarly, the width of the second lateral pocket 14 is measured along the top edge from the second lateral edge and a second short notch 18 (shown in FIG. 4) is cut in the fabric. Next, a seam is sewn along the free or unfolded edge 20 of the first lateral pocket 12, also using an overlooking stitch. A seam is then sewn along the free or unfolded edge 22 of the second lateral pocket 14, also using an overlock stitch. The lateral edges of the fabric are folded inward on the body of the fabric, the fold lines running along the notches 18 (shown in FIG. 4). Before the left and right lateral edges are folded inward, first a seam is formed along each unfolded edge of each pocket with the overlock stitch. A total of four indicator notches are cut into each book cover: one each on the top left and right, bottom left and right.

FIG. 2 shows a top seam sewn along the top edge of the rectangular piece using an overlock stitch. The top seam begins at the fold line adjacent the front cover portion at a point about ⅜" below the top edge of the rectangular piece in a straight line and at an upward angle to the beginning of spine area 10*a*, defining a closed top edge of the pocket 12. The triangular wedge shaped piece of material between the top seam and the top edge of the rectangular piece is cut off by the overlock stitching. The effect of the overlock stitch cutting off the top edge of the rectangular piece is that it reduces this outside edge. There are significant benefits thus provided: the cover clings snugly to the book without interfering with the cover being applied to a book, and a larger cover may be applied to a smaller book without the cover falling off. Thus, the cover has a somewhat "one size fits all" characteristic. The top seam continues along the top edge of the rectangular piece across the remainder of the front cover portion 10*b*, the spine area 10*a*, and the back cover portion 10*c*. The top seam then continues in a straight line and at a downward angle to a point about ⅜" below the top edge of the rectangular piece and on the fold line adjacent the back cover portion 10*c*, defined a closed top edge of the second lateral pocket 14. The triangular wedge shaped piece between the closed top edge of the second lateral pocket 14 and the top edge of the rectangular piece is also cut off by the overlock stitching. Significant benefits of the overlock stitch are noted above and, of course, apply here.

The orientation of the rectangular piece is then rotated by 180°, and a bottom seam is sewn across the bottom edge of the rectangular piece in the same manner as the top seam. In other words the bottom seam is continuous along the bottom edge of the cover 10, including a closed bottom edge of the first lateral pocket 12, continuing along the remainder of the front cover portion 10*b*, the spine area 10*a*, and the back cover portion 10*b*, continuing to define a closed bottom edge of the second lateral pocket 14.

Finally, the cover 10 is inverted, the pockets being turned inside out. It will be understood by those skilled in the art that if the thread used to stitch the seams is elastic, the fabric may be stretched while sewing the seams so that the seams stretch with the fabric.

In use, the front cover 5*a* of the book 5 is placed in the first lateral pocket 12, and the back cover 5*b* of the book 5 is placed in the second lateral pocket 14. The book 5 does not need to be bent back to apply the present invention 4, thus avoiding undue stress on the book 5 spine and improper handling of the book 5. The present invention 10 can be placed on any given book. Since the folded edge of each pocket 12 and 14 is approximately ¾" shorter than the unfolded edge, the pockets 12 and 14 must be stretched to insert the covers of the book 5 and the resilience of the fabric keeps the cover 10 in place on the book 5, and the resulting stretch of the fabric makes the free edges 20 and 22 of the pockets 12 and 14 appear to be arcuate. Again, the importance of the use of overlock stitching in providing the advantages of snug clinging of the cover and allowing a larger cover to be applied to a smaller book are significant here.

The unique curve 20 and 22 (arcuate shape) results from the way the material is cut and the method of stitching all lateral and free edges. The unique curve results specifically from the way the book cover 10 is sewn which is angled upward from the lateral pockets 12 and 14 to the spine area 10*a*. The curve 20 and 22 eliminates sagging of the cloth book cover 4 at the top and bottom spine areas. Sagging is unsightly and leaves uncovered areas unprotected. This spine securing feature 20 and 22 is achieved more from how fabric is sewn and less on how it is cut, eliminating the need for overly stringent, tedious, and exacting skills thereby reducing the high probability of waste through mistakes. Advantageously, the unique sewing pattern results in supporting the book cover 4 at the spine of the book 5 with a minimum of tension caused by the elastic stretch of the fabric.

Accordingly, the method of making the improved cloth book cover according to the invention includes the steps of:

(a) providing a substantially rectangular sheet of flexible, elastic cloth fabric having a top edge, a bottom edge, a first lateral edge, and a second lateral edge;

(b) cutting a first notch along the top and bottom edges at a predetermined distance from the first lateral edge;

(c) cutting a second notch along the top and bottom edges at a predetermined distance from the second lateral edge;

(d) stitching an overlock stitch along the unfolded edge of said first lateral pocket;

(e) stitching an overlock stitch along the unfolded edge of said second lateral pocket;

(f) folding the material at said first and second notches in order to define a first lateral pocket having a folded edge and a parallel unfolded edge, and a second lateral pocket having a folded edge and an unfolded edge;

(g) sewing a top seam across the top edge of said rectangular piece using an overlock stitch, said top seam beginning at a point along the fold line of said first lateral pocket located about ⅜ inches below the top edge, continuing angularly upward to the near end of spine area;

(h) thence continue sewing said top seam along the top edge of said rectangular piece to the far end of spine area (the spine area measures approximately three to four inches wide);

(i) thence continue sewing said top seam angularly downward to a point located on the folded edge of said second lateral pocket about ⅜ inches below the top edge of said rectangular piece;

(j) sewing a bottom seam across the bottom edge of said rectangular piece using an overlock stitch, said bottom seam beginning at a point along the fold line of said first lateral pocket located about ⅜ inches above the bottom edge, continuing angularly downward to the near end of spine area;

(k) thence continue sewing said bottom seam along the bottom edge of said rectangular piece to the far end of spine area;

(l) thence continue sewing said bottom seam angularly upward to a point located on the folded edge of said second lateral pocket about ⅜ inches above the bottom edge of said rectangular piece; and (m) inverting said cover, including inverting said first and second lateral pockets.

Figure 5:
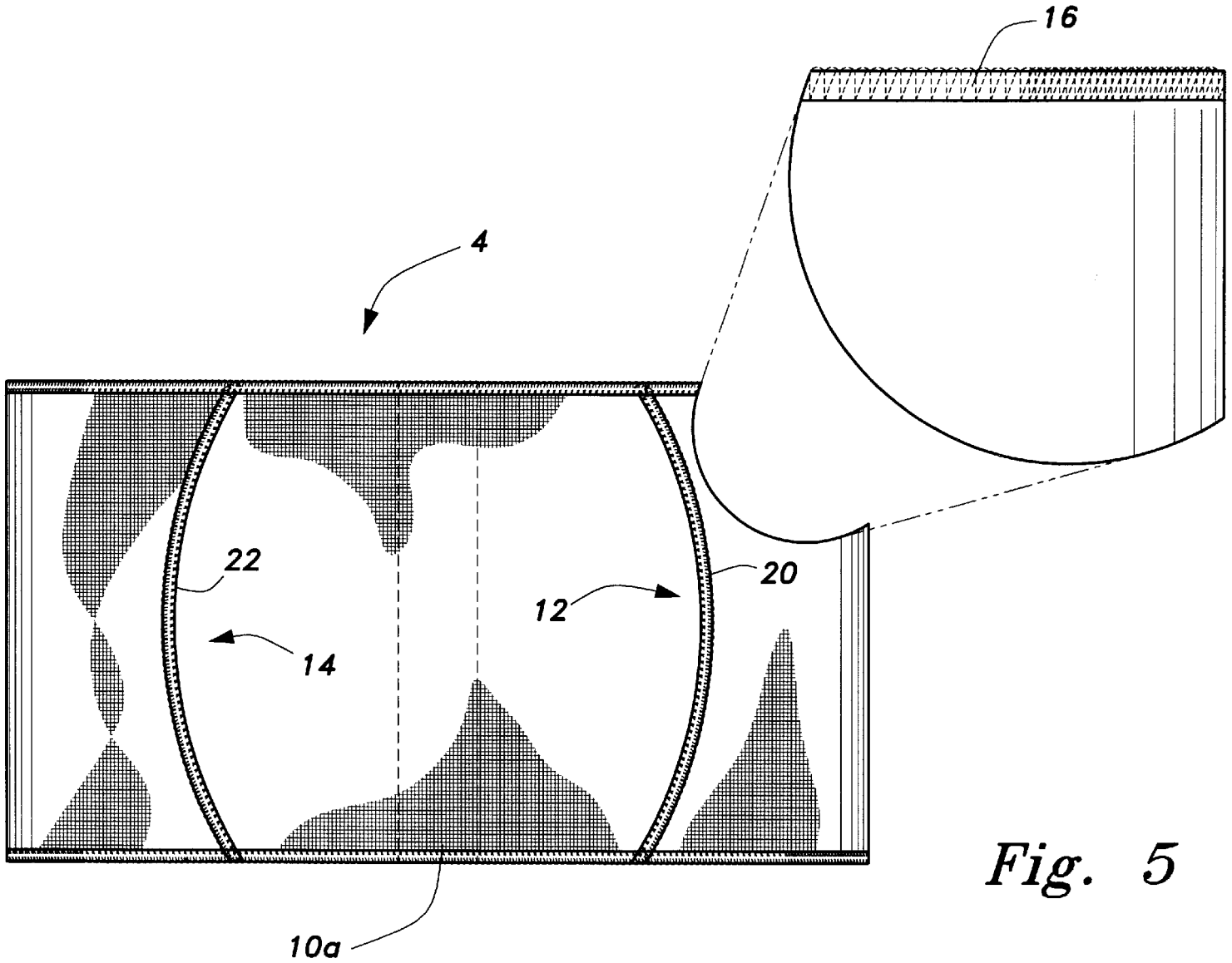
FIG. 5 is a perspective view of the pattern sewn at the top and bottom edges of the book cover.

FIGS. 3 and 5 illustrate the unique curve that is created through a sewn pattern 16 utilized at the top and bottom edges of the book cover 4. The book cover 4 is cut from an elastic-like material in the shape and size of a book. One or two comparable sizes of the book covers 10 are adequate for all hard covered books. The only limitation is that the hard covered books must be larger than the book cover to any degree to take advantage of the stretchy nature of the fabric. The unique curve 20 and 22 (arcuate shape) results from the way the material is cut and the method of stitching 16 all lateral and free edges.

The curve 20 and 22 eliminates sagging of the cloth book cover 4 at the top and bottom spine areas 10*a*. Sagging is unsightly and leaves uncovered areas unprotected. This spine securing feature 20 and 22 is achieved more from how fabric is sewn 16 and less on how it is cut, eliminating the need for overly stringent, tedious, and exacting skills thereby reducing the high probability of waste through mistakes.

Sewing the top and bottom spine edges 10*a* eliminates tearing of the fabric at these sites. It also prevents curling and fraying. The sewn edges provide needed reinforcement; they are sturdy and durable. The sewn edges also add aesthetic enhancements as they provide a professional, finished look to the cloth book cover 10.

Furthermore, utilizing the stretch ratio of the fabric, the corners are tapered to provide a snug fit to smaller books while giving the spine adequate coverage on the larger books; larger books stretch the fabric out on this tapered edge.

While other advantages may be intrinsic to the cloth book cover 10 and method as herein disclosed, it is to be understood that the present invention is not limited to the sole embodiments described above, but encompasses any and all embodiments within the scope of the following claims.

I claim:

1. A cloth book cover adapted for covering a bound book, comprising a cloth cover made from an elastic fabric having:

a) a front cover portion;

b) a back cover portion;

c) a spine area joining said front cover portion and said back cover portion;

d) a first lateral pocket defined in said front cover portion, the pocket having a folded edge and an unfolded edge parallel to the folded edge, said pocket being adapted for receiving a front cover of a book;

e) a second lateral pocket defined in said back cover portion, the pocket having a folded edge and an unfolded edge parallel to the folded edge, said pocket being adapted for receiving a back cover of a book; and wherein f) the folded edges of said first and second lateral pockets are about three quarters of an inch shorter than the unfolded edges of said first and second lateral pockets, respectively.

2. The cloth book cover according to claim 1, wherein said cloth book cover is made from a material which is water resistant.

3. The cloth book cover according to claim 1, wherein said cloth book cover is made from a material which is flame retardant.

4. The cloth book cover according to claim 1, wherein said cloth book cover is made of a stretchy material.

5. The cloth book cover according to claim 1, further comprising:

a) a top seam formed by overlock stitching extending across said front cover portion, said spine area, and said back cover portion, defining a closed top edge of said first lateral pocket and defining a closed top edge of said second lateral pocket; and b) a bottom seam formed by overlock stitching extending across said front cover portion, said spine area, and said back cover portion, defining a closed bottom edge of said first lateral pocket and defining a closed bottom edge of said second lateral pocket.

6. The cloth book cover according to claim 1, further comprising:

a) a seam formed along the unfolded edge of said first lateral pocket by overlock stitching; and b) a seam formed along the unfolded edge of said second lateral pocket by overlock stitching.

7. The cloth book cover according to claim 1, wherein said top seam and said bottom seam include an overlooking stitch which inwardly tapers to create a curve in said first and second lateral pockets.

8. A method of making a cloth book cover, comprising the steps of:

(a) providing a substantially rectangular sheet of flexible, elastic cloth fabric having a top edge, a bottom edge, a first lateral edge, and a second lateral edge;

(b) cutting a first notch along the top and bottom edges at a predetermined distance from the first lateral edge;

(c) cutting a second notch along the top and bottom edges at a predetermined distance from the second lateral edge;

(d) stitching an overlock stitch along the unfolded edge of said first lateral pocket;

(e) stitching an overlock stitch along the unfolded edge of said second lateral pocket;

(f) folding the material at said first and second notches in order to define a first lateral pocket having a folded edge and a parallel unfolded edge, and a second lateral pocket having a folded edge and an unfolded edge;

(g) sewing a top seam across the top edge of said rectangular piece using an overlock stitch, said top seam beginning at a point along the fold line of said first lateral pocket located about ⅜ inches below the top edge, continuing angularly upward to the near end of spine area;

(h) thence continue sewing said top seam along the top edge of said rectangular piece to the far end of spine area (the spine area measures approximately three to four inches wide);

(i) thence continue sewing said top seam angularly downward to a point located on the folded edge of said second lateral pocket about ⅜ inches below the top edge of said rectangular piece;

(j) sewing a bottom seam across the bottom edge of said rectangular piece using an overlock stitch, said bottom seam beginning at a point along the fold line of said first lateral pocket located about ⅜ inches above the bottom edge, continuing angularly downward to the near end of spine area;

(k) thence continue sewing said bottom seam along the bottom edge of said rectangular piece to the far end of spine area;

(l) thence continue sewing said bottom seam angularly upward to a point located on the folded edge of said second lateral pocket about ⅜ inches above the bottom edge of said rectangular piece; and (m) inverting said cover, including inverting said first and second lateral pockets.

* * * * *